United States Patent [19]

Koshman et al.

[11] 4,281,304

[45] Jul. 28, 1981

[54] ELECTRIC CIRCUIT SWITCHGEAR

[76] Inventors: Vitaly I. Koshman, bulvar Shevchenko, 123, kv. 25; Vladimir F. Petrichenko, ulitsa Prozhektornaya, 6, kv. 44; Boris S. Gnilitsky, ulitsa Artema, 116, kv. 21, all of Donetsk; Vyacheslav G. Mironenko, ulitsa Stromynka, 11, korpus 2, kv. 120, Moscow; Pavel V. Kamshitsky, prospekt Mira, 53a, kv. 23, Donetsk, all of U.S.S.R.

[21] Appl. No.: 15,167

[22] Filed: Feb. 26, 1979

[51] Int. Cl.[3] ..... H01H 3/26

[52] U.S. Cl. ..... 335/72; 335/121; 335/139

[58] Field of Search ..... 335/72, 77, 139, 118, 335/121

[56] References Cited

U.S. PATENT DOCUMENTS

| | | | |
|---|---|---|---|
| 2,668,261 | 2/1954 | Hooker et al. | 335/139 |
| 3,233,066 | 2/1966 | Stoddard et al. | 335/118 |
| 3,755,765 | 8/1973 | Reaves, Jr. | 335/118 |

*Primary Examiner*—Harold Broome

*Attorney, Agent, or Firm*—Lackenbach, Lilling & Siegel

[57] ABSTRACT

An electric circuit switchgear includes main contacts circumferentially arranged on a fixed panel and auxiliary contacts. The switchgear also includes a rotary electromechanical drive connected with a driving shaft and enabling the latter to be turned through a pre-set angle. The driving shaft is rotated together with an actuating element of an electromagnetic drive provided with a contactor and a disconnector both having at least one projection interacting with the main and auxiliary contacts through contact closing and disconnecting mechanisms having locks.

3 Claims, 7 Drawing Figures

ELECTRIC CIRCUIT SWITCHGEAR

FIELD OF THE INVENTION

The present invention relates to remote control of electric power actuated members, and more particularly to electric circuit switchgears.

The invention may be used in apparatus for controlling the energization of a group of electric power actuated members, such as electric motors, in various branches of industry, for example, in coal-mining.

BACKGROUND OF THE INVENTION

There are prior art means for controlling a group of electric motors (control stations) including a plurality of contactors, intermediate electromagnetic relays and other switching elements, the number of which is dictated by the number of electric motors to be controlled. Such means are complicated, cumbersome and of low reliability.

The known means are particularly disadvantageous when used in the equipment for controlling the energization of machines operated in mines, in dangerously explosive environment. To comply the necessary measures for safe operation under these conditions, a number of special requirements are to be met, and among them is checking of the insulation of an electric circuit connecting the processing equipment and the supply mains. Such checking is to be carried out before the circuit is energized.

To meet such requirements, it is necessary to use special check meters in every set of equipment for controlling an individual power actuated member.

Known in the art is a high voltage switchgear (USSR Inventor's Certificate No. 320846) which includes a fixed panel with contacts arranged around a circumference, an electromagnetic drive, whose actuating element rotates about an axis passing through the center of said circumference perpendicularly to the contact plane and reciprocates along said axis. The switchgear additionally includes a switch unit rigidly connected with the actuating element of the electromagnetic drive for switching over the contacts, when the electromagnetic drive comes into operation. In this switchgear, an electromagnet armature which is an actuating element is provided with a cam in the form of a sleeve having a saw-like groove variable in depth and made around its cylindrical surface to accomodate a pin fixed to the electromagnet casing for running in said groove.

As the electromagnet coil is energized, the armature is attracted thereinto. The pin moves along the saw-like groove of the cam and, in acting thereupon, turns the armature together with the switch element through an angle corresponding to the pich of the saw-like groove.

However, the above switchgear may be used only for a sequential switching of circuits to be energized and is unsuitable for a selective switching of individual power actuated members.

In addition, the above switchgear is unfit for performing such a switching operation, which enables all the circuits or a part of them to be energized simultaneously.

It should be noted that the switchgear being described is provided with no means for protecting the circuits in case the power supply is interrupted.

Thus, the described switchgear may be used for switching power circuits only in combination with auxiliary switch elements.

Therefore, when the above switchgear is employed for controlling a plurality of power actuated members it is impossible to substantially reduce the number of relays and other auxiliary switch elements.

SUMMARY OF THE INVENTION

It is the main object of the present invention to provide an electric circuit switchgear with a common switch contact drive enabling power actuated members to be controlled selectively.

It is another object of the invention to provide an electric circuit switchgear capable of performing such a switching operation which enables all the controlled circuits, or a number of them, to be energized simultaneously.

It is a further object of the invention to substantially reduce the number of switch elements required for controlling a plurality of power actuated members.

These and other objects of the invention are attained by an electric circuit switchgear comprising a fixed panel with a plurality of main contacts arranged around a circumference, an electromagnetic drive whose actuating element rotates about an axis passing through the center of said circumference perpendicularly to the contact plane and reciprocates along said axis, a switch unit rigidly connected with the electromagnetic drive actuating element to switch over the contacts when the electromagnetic drive comes into action, according to the invention, is provided with a rotary electromechanical drive connected with the driving shaft and enabling the driving shaft to be turned through a pre-set angle, and has auxiliary contacts for switching over the switchgear control circuits, the electromagnetic drive having an electromagnet for closing the contacts and at least one electromagnet for disconnecting the contacts, the electromagnetic drive actuating element comprising an armature of the contact closing electromagnetic mounted on the driving shaft for running therealong and rotating therewith, and an armature of at least one contact disconnecting electromagnet reciprocating when the contacts are disconnected, the switch unit having a contactor fixed to the armature of the contact closing electromagnet and a disconnector fixed to the armature of the contact disconnecting electromagnet, and wherein both the contactor and the disconnector having at least one projection acting upon the main contacts through contact closing and disconnecting mechanisms provided with contact locks and cooperating with the auxiliary contacts.

The above described modification of the electric circuit switchgear makes it possible to accomplish a selective control of the energization of electric power actuated members included into a plurality of circuits being switched. Such control may, for example, be accomplished in accordance with a program pre-set by any suitable known device.

It is advantageous to make the switchgear in such a way that the rotary electromechanical drive comprise an electric motor and a device made as a disk-like support for pre-setting an angle of rotation of the driving shaft, which device is rotated by the electric motor shaft cooperating with contact breakers disposed around a circumference, whose center coincides with the axis of rotation of the electric motor shaft, and enabling the electric motor to be stopped and the electromagnet drive to come into action simultaneously.

Such a construction of the switchgear of the present invention enables a plurality of electric power actuated members to be controlled by manually pushing associated buttons included into the switching network.

It is advantageous to accomplish the electric circuit switchgear according to the invention in such a way that the armature of one of the contact disconnecting electromagnets be provided with an element simultaneously interacting with all the contact closing and disconnecting mechanisms when the power supply is interrupted.

The electric circuit switchgear according to the invention makes it possible to enhance the safety of operation of power actuated members.

The invention will become more readily apparent from the following detailed description of the embodiments thereof with reference to the accompanying drawings, wherein.

The electric circuit switchgear includes a lower insulating panel 1 (FIG. 1) with main contacts 2 disposed circumferentially in equally spaced relationship. In the embodiment of the invention being described, which is adapted for switching power circuits, the main contacts 2 are housed in vacuum arc-supressing chambers 3. The number of main contacts 2 is determined by the number of circuits to be switched. On the lower insulating panel 1 there are also mounted contact closing and disconnecting mechanisms 4. The number of the mechanisms 4 is equal to the number of the main contacts 2.

Figure 2:
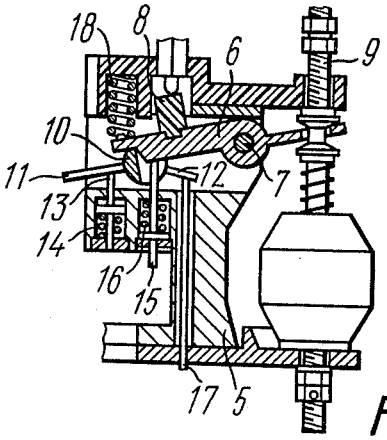
FIG. 2 illustrates the unit A of FIG. 1.

According to the invention, each of the mechanisms 4 includes a casing 5 (FIG. 2), enclosing a pivoted lever 6, which is mounted on a shaft 7, and pushers 8 fixed to the pivoted lever 6. The inner arm of the pivoted lever 6 has a shoulder interacting with a lock. The outer arm of the pivoted lever 6 interacts with a movable rod 9 of the main contact 2. The lock is made as a roller 10 having a flat face interacting with the shoulder on the inner arm of the pivoted lever 6. Besides, the roller 10 is provided with an inner stem 11 and an outer stem 12. The lock also includes a rod 13 disposed in the casing 5 and provided with a return spring 14. The contact closing and disconnecting mechanism 4 also comprises a rod 15 with a return spring 16 to turn the lever 6 when the contacts 2 are closed, a rod 17 bearing up against the outer stem 12 of the roller 10, and an actuating spring 18.

Figure 1:
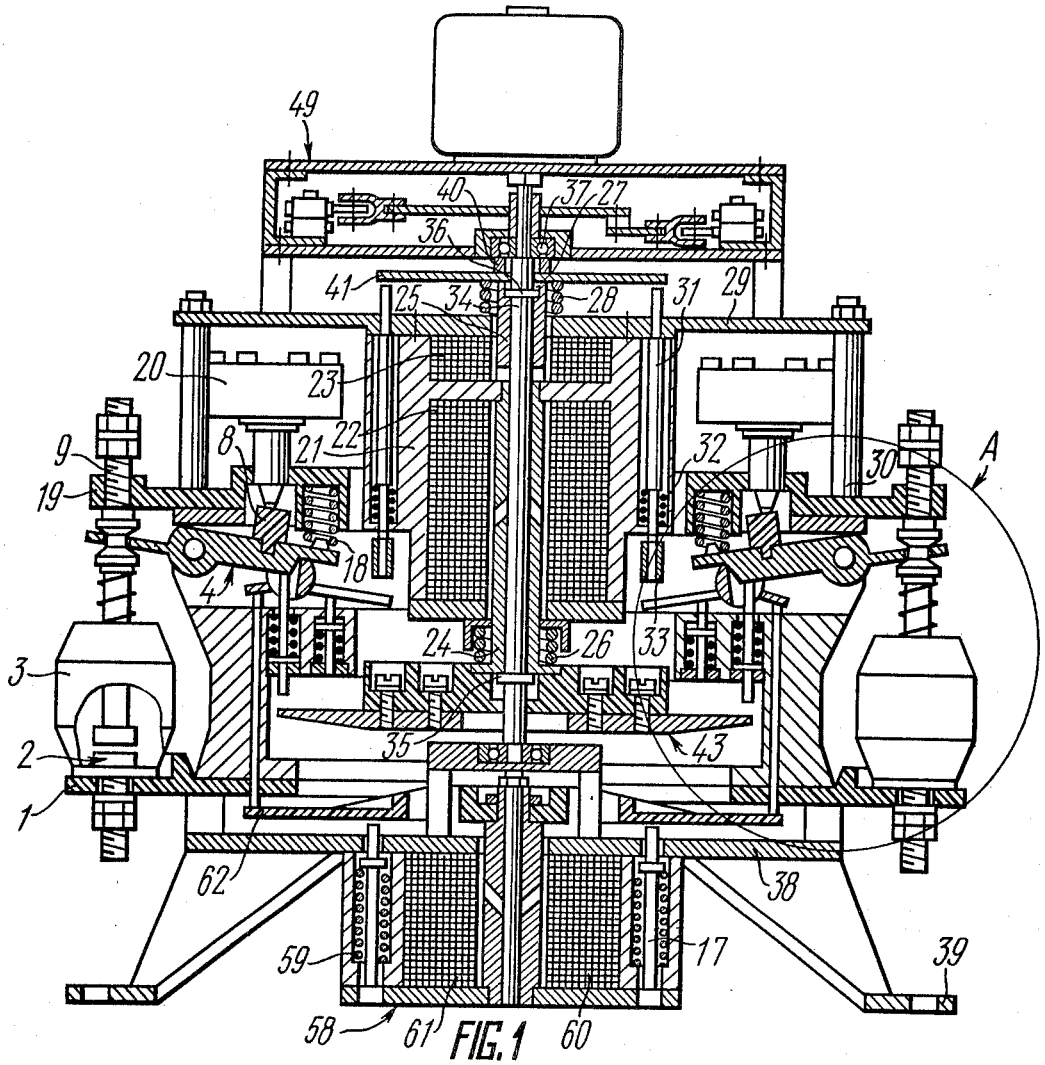
FIG. 1 illustrates a sectional general view of the electric circuit switchgear according to the invention.

The embodiment of the invention being described is also provided with an intermediate insulating panel 19 (FIG. 1) having openings with auxiliary contacts 20 fixed therein for closing or disconnecting the switchgear control circuits (not shown). Besides, the panel has recesses to accomodate the actuating springs 18 (FIG. 2) and a central opening to enclose an electromagnetic drive casing 21 (FIG. 1). The intermediate insulating panel 19 is also provided with circumferentially disposed openings which loosely enclose the movable rods 9 of the main contacts 2.

The casing 21 also acts as a magnetic circuit. The casing 21 and a coil 22 enclosed therein form an electromagnet for closing both the main contacts 2 and the auxiliary contacts 20. Besides, the casing 21 together with a coil 23 also disposed therein form an electromagnet for disconnecting both the main contacts 2 and the auxiliary contacts 20. The coils 22 and 23 enclose respectively armatures 24 and 25, which in combination therewith form an actuating element of the electromagnetic drive. The armature 24 is a hollow cylinder having a flange at one of its ends with a return spring 26 resting thereon. The armature 25 is a hollow cylinder with a slit 27 at one of its ends and provided with a return spring 28.

The casing 21 of the electromagnetic drive is fixed to an upper base 29 which is a metal disk fastened through studs 30 to the intermediate insulating panel 19. The upper base 29 and the electromagnetic drive casing 21 are provided with circumferentially arranged openings to enclose rods 31 interacting with the inner stems 11 of the rollers 10. The rods 31 are provided with return springs 32 disposed within the casing 21 and have insulating tips 33.

The upper base 29 has a central opening to enclose the armature 25 of the contact disconnecting electromagnet.

The armatures 24 and 25 are made hollow and enclose a driving shaft 34 with openings for pins 35 and 36. The openings in the driving shaft 34 are arranged in such a way that the pin 33 is disposed under the flange of the armature 24 and the pin 36 is within the slit 27 of the armature 25.

The driving shaft 34 is disposed in ball bearings 37 which may be mounted in the stationary switchgear structure elements in any conventional manner. In the embodiment of the invention being described the bearings 37 are mounted in a lower base 38 and the upper base 29. The lower base 38 may be provided with supports 39 for mounting the switchgear, for example, in the housing of a control station.

Figure 3:
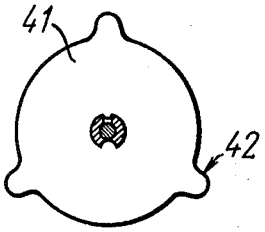
FIG. 3 illustrates a modification of the disconnector according to the invention.

The upper portion of the armature 25 is threaded to conform to a nut 40. This threaded joint is adapted for securing a disconnector 41 to the armature 25. In this embodiment of the invention, the disconnector 41 (FIG. 3) is made as a disk having a central opening and projections 42. The number of the projections 42 is dictated by the type of circuits to be switched (a.c. polyphase or monophase circuits and d.c. circuits).

The drawings illustrate the disconnector 41 adapted to operate in a.c. three-phase circuits. In the electric circuit switchgear completely assembled, the projections 42 are arranged above the rods 31 of the contacts 2 to be disconnected.

Figure 4:
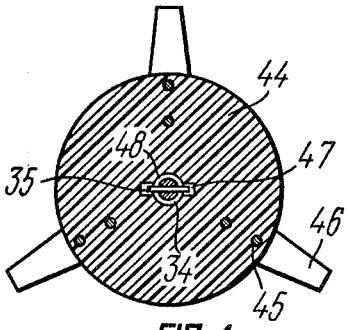
FIG. 4 illustrates a modification of the contactor according to the invention.

For closing the contacts, the flange of the electromagnet armature 24 is provided with a contactor 43 which in this embodiment of the invention is made of an insulating material in the form of a disk 44 (FIG. 4). Fixed to the disk 44 by means of bolts 45 are pressing plates 46, the number of which is also dictated by the type of circuits to be switched.

FIG. 4 illustrates a modification of the contactor 43 for operating in three-phase circuits. The central portion of the disk 44 has a slit 47 to accomodate the pin 35 while the switchgear is being assembled, and an opening 48 for letting the driving shaft 34 through.

Figure 5:
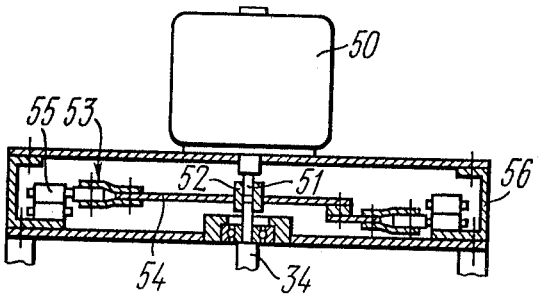
FIG. 5 illustrates a modification of the rotary electromechanical drive according to the invention.

According to the invention, the electric circuit switchgear is provided with a rotary electromechanical drive 49 adapted to turn the driving shaft 34 through a pre-set angle. The angle magnitude is dictated by the position of the main contact 2 on the lower insulating panel 1. In this embodiment of the invention, the drive 49 comprises an electric motor 50 (FIG. 5) whose shaft 51 is connected through a sleeve 52 with the driving shaft 34. Besides, the drive 49 comprises a device 33 for setting an angle of rotation of the driving shaft 34, which device is made as a disk-like support 54 fixed to the sleeve 52, has limit switches 55 disposed within the housing 56 around a circumference whose center coincides with the axis of rotation of the driving shaft 34, and rolls 57*a*, 57*b*, 57*c* (FIG. 6) mounted on the disk-like support 54 and interacting with the limit switches 55.

Figure 6:
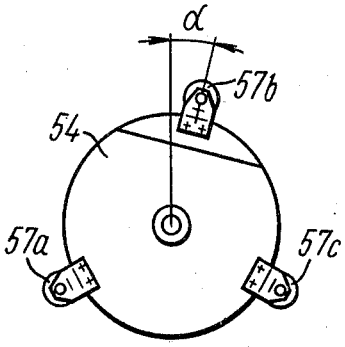
FIG. 6 illustrates a modification of the disk-like support according to the invention.

The number of rolls 57 is determined by the number of contacts 2 required for constructing a control network. As a rule, each of the rolls 57*a*, 57*b*, 57*c* is disposed above the pressing plate 46 of the contactor 43 and above the projection 42 of the disconnector 41, but if it is necessary to switch over particular contacts in advance or with a delay, one or some of the rolls 57 may be circumferentially displaced through a required angle. As shown in FIG. 6, the roll 57*b* is circumferentially displaced through an angle $\alpha$ with its vertex in the center of symmetry of rolls 57*a*, 57*b* and 57*c*.

The device 53 for setting an angle of rotation of the driving shaft 34 is mounted on the upper base 29.

Possible is another modification of the rotary electromechanical drive 40 enabling the driving shaft 34 to be turned through a pre-set angle, wherein, as an alternative to the drive 49, may be used, for example, a step motor. The structure principle of such drive is well known to those skilled in the art.

In a further embodiment of the invention, the switch unit comprises an electromagnet 58 for disconnecting the contacts. The electromagnet is housed in a casing (magnet circuit) 59 enclosing a coil 60 with an armature 61. Fixed to the armature 61 through a threaded joint is a disk 62 made of an insulating material. Against the disk 62 circumferentially bear up the rods 17*a*. Such an arrangement of the electromagnet 58 serves for simultaneously breaking all the main contacts 2 in case the power supply is interrupted.

Figure 7:
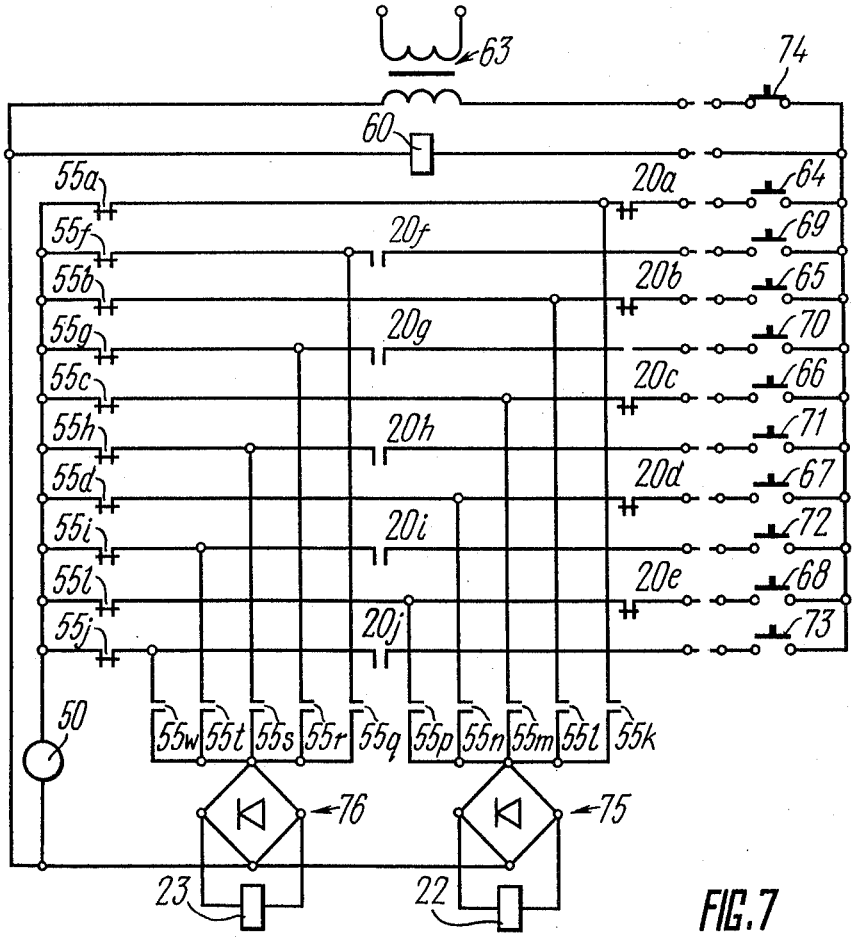
FIG. 7 illustrates a schematic wiring diagram for controlling power actuated members, which is suitable for using the electric circuit switchgear according to the invention.

FIG. 7 shows, by way of example, a diagram of a control network for five power actuated members (power circuits are not shown), which, in addition to the switchgear of the invention, includes a transformer 63, "Start" buttons 64, 65, 66, 67, 68, "Stop" buttons 69, 70, 71, 72, 73, a "Stop-All" button 74 and rectifiers 75, 76 each mounted according to a bridge circuit. The rectifiers 75 and 76 serve for supplying power to the contact closing electromagnet and the contact disconnecting electromagnet, respectively. The diagram also shows circuit breaking contacts 20*a*, 20*b*, 20*c*, 20*d*, 20*e* of the auxiliary contacts 20, circuit closing contacts 20*f*, 20*g*, 20*h*, 20*i*, 20*j* of the auxiliary contacts 20, circuit breaking contacts 55*a*, 55*b*, 55*c*, 55*d*, 55*e*, 55*f*, 55*g*, 55*h*, 55*i*, 55*j* of the limit switches 55, and circuit closing contacts 55*k*, 55*l*, 55*m*, 55*n*, 55*p*, 55*q*, 55*r*, 55*s*, 55*t*, 55*w* of the limit switches 55.

The above described electric circuit switchgear operates as follows. When one of the "Start" buttons (for example, the button 64) is pushed, the electric motor 50 of the rotary electromechanical drive 49 is energized through a circuit including the secondary winding of the transformer 63, the "Stop-All" button 74, the button 64, the breaking contact 20*a* of the auxiliary contact 20, the breaking contact 55*a* of the limit switch 55, and the electric motor 50. The electric motor 50 starts rotating and rotates the driving shaft 34 together with the contactor 43, disconnector 41 and the device 53 which cooperates with the limit switches 55.

When the roll 57 approaches the limit switch 55 corresponding to a pushed button and the main contacts to be closed, the limit switch 55 is switched over under the action of the roll 57 and its contacts 55*a* get opened and break the circuit of the electric motor 50, while the contacts 55*k* of the same limit switch are connected to the secondary winding of the transformed 63 and the coil 22 of the contact closing electromagnet through the rectifier 75. Therefore, the electric motor 50 is stopped, the contact closing electromagnet operates, and the contactor 43 connected with the armature 24 closes the chosen contacts 2 through the plates 46 when the armature 24 is moved upwards along the axis of the driving shaft 34.

Therefore, due to the presence of the limit switches 55 interacting with the rotary driving shaft 34, the rotary electromechanical drive turns said shaft through a pre-set angle, stops at a pre-selected position of the driving shaft 34 and switches on the electromagnetic drive.

The closure of the contacts 2 is accomplished by pressing the plates 46 of the contactor 43 against the rods 15 which act upon the pivoted levers 6 of the contact closing and disconnecting mechanisms 4.

As this takes place, each of the pivoted levers 6 is turned and, in compressing the return spring 18 by the inner arm and releasing the movable rods 9 of the main contacts 2 by the outer arm, it enables the contacts to be closed under the atmospheric pressure, while the pusher 8 acts upon the auxiliary contacts 20. At the end of the travel of the rod 15, the position approached by the pivoted lever 6 is fixed by the contact lock roller 10 which is turned by the spring-loaded rod 13 acting upon the inner stem thereof. As a result, the contact 20*a* of the auxiliary contact 20 is opened. Therefore, the contact closing electromagnet coil 22 is deenergized, and the armature 24 with the contactor 43 are moved under the action of gravity and return spring 26 to the initial (lower) position.

From this moment the switchgear is ready for selecting and closing another group of main contacts 2 in the manner described above.

As clearly seen from the foregoing description, the contact closing electromagnet is a quick-acting device.

The disconnection of the selected contacts is performed in a similar way differing only in that instead of a "Start" button, one of the "Stop" buttons (e.g., the button 69) is to be pushed. In this case the same electric motor 50 is energized through one of the closing contacts 20*f*–20*j* closed as the main contacts 2 are closed, the pushed button and one of the contacts 55*f*–55*j* of the limit switches corresponding to the pushed button.

The contact 55*f* of the limit switch is disconnected under the action of the roll 57, when the latter approaches a corresponding position. As a result, the electric motor 42 is deenergized and stopped. At the same time an associated contact in the group of the contacts 55*g*–55*w* of the limit switches is closed and the coil 23 of the contact disconnecting electromagnet is energized to disconnect the contacts through the circuit of the rectifier bridge 76.

When this electromagnet comes into action, the disconnector 41 joined with the electromagnet armature 25 is shifted downwards along the driving shaft 34 and through the projections 42 acts by the spring-loaded rods 31 upon the inner stems 11 of the contact lock rollers 10, thereby disengaging the pivoted levers 6.

Under the action of the actuating springs 18 the pivoted levers are turned and through the outer arms act upon the movable rods 9 to disconnect the contacts 2.

As this takes place, an associated auxiliary contact (in the group of 20*f*–20*j*) is disconnected and the contact disconnecting electromagnet coil is deenergized. Therefore, the contact disconnecting electromagnet, like the contact closing electromagnet, is a quick-acting device.

When the switchgear of the invention is operated, the armature 61 of the electromagnet 58 is attracted to the magnetic circuit.

In case of a damage or emergency, all the controlled circuits are broken by pushing the "Stop-All" button 74, which breaks the power supply circuit of the coil 60 and, as a result, the armature 61 and the insulating disk 62 joined therewith are displaced upwards under the action of the spring-loaded rods and act through the rods 17 upon the outer stems 12 of the contact lock rollers 10.

In turning about the axes, the rollers 10 release the pivoted levers 6, as described above, and in coating with the rods 9, they disconnect the contacts 2. All the contacts 2 are similarly disconnected in case the power supply is interrupted in the circuit involving the switchgear being described, thereby providing a protection of the controlled power actuated members.

One of the characteristic features of the switchgear being described is that the contacts thereof are switched over with a more or less time delay depending on the mutual arrangement of the plates of the contactor 43 and the contacts to be switched over. However, when the same contacts are reused, the time intervals between switchings equal to those of conventional contactors.

In some cases this feature may be useful. Thus, in case of mine explosive-proof apparatus, it is necessary to check the insulation resistance prior to the controlled circuit is connected to the supply mains.

Such pre-switch-on check may be accomplished due to the provision of the disk-like support 54 with the roll 57*f* which is displaced through an angle with respect to the plane of the plates 46 of the contactor 43 and acts upon the group of the limit switches 55 electrically connected with a control apparatus and circuits to be controlled. Therefore, all the circuits may be controlled by a single control apparatus as contrasted to known switchgears, wherein each of the circuits is controlled by means of an individual control apparatus.

It should be noted that the claimed switchgear makes it possible to use only one intermediate relay for the whole group of the controlled power actuated members and even dispense with an intermediate relay, which is an additional advantage of the invention.

What is claimed is:

1. An electric circuit switchgear comprising:

a fixed panel;

a plurality of main contacts circumferentially arranged on said panel;

a plurality of auxiliary contacts for switching over the switchgear control circuits;

a driving shaft;

a rotary electromechanical drive for turning said driving shaft through a pre-set angle;

an electromagnetic drive having an electromagnet for closing said main and auxiliary contacts, at least one electromagnet for disconnecting said main and auxiliary contacts, and an actuating element, said actuating element of said electromagnetic drive including an armature of said electromagnet for closing said main and auxiliary contacts, which armature being mounted on said driving shaft for moving along the axis thereof and rotated together with said driving shaft;

an armature of at least one of said electromagnets for disconnecting said main and auxiliary contacts, which armature reciprocating when said main and auxiliary contacts are disconnected; and a plurality of mechanisms for closing and disconnecting said main and auxiliary contacts, which mechanisms having locks for said main and auxiliary contacts;

a switch unit for switching over said main and auxiliary contacts when said electromagnetic drive comes into action, which unit includes a contactor fixed on said armature of said electromagnet for closing said main and auxiliary contacts, a disconnector fixed on said armature of said electromagnet for disconnecting said main and auxiliary contacts, both said contactor and said disconnector having at least one projection acting upon said main and auxiliary contacts through said mechanisms for closing and disconnecting said main and auxiliary contacts.

2. An electric circuit switchgear according to claim 1, wherein said rotary electromechanical drive comprises:

an electric motor;

a device for setting an angle of rotation of said driving shaft, which device includes:

a disk-like support rotated by said electric motor, and a plurality of limit switches arranged around a circumference whose center coincides with the axis of rotation of said electric motor shaft, said limit switches interacting with said disk-like support and enabling said electric motor to be stopped and said electromagnetic drive to come into action simultaneously.

3. An electric circuit switchgear according to claim 1, wherein said armature of one of said electromagnets for disconnecting said main and auxiliary contacts is provided with an element interacting simultaneously with all said mechanisms for closing and disconnecting said main and auxiliary contacts, in case the power supply is interrupted.

* * * * *